United States Patent [19]

Lindemann

[11] 4,406,034

[45] Sep. 27, 1983

[54] SELF-CLOSING DOOR HINGE

[75] Inventor: Elmer A. Lindemann, Ft. Wright, Ky.

[73] Assignee: Superior Door Corporation, Cincinnati, Ohio

[21] Appl. No.: 285,853

[22] Filed: Jul. 21, 1981

[51] Int. Cl.[3] ..... E05F 1/14

[52] U.S. Cl. ..... 16/284; 16/285; 16/313; 16/DIG. 10; 49/9; 49/237

[58] Field of Search ..... 16/50, 76, 284, 285, 16/303, 307, 313, DIG. 10; 49/9, 237

[56] References Cited

U.S. PATENT DOCUMENTS

| | | | |
|---|---|---|---|
| 68,376 | 9/1867 | McOmbek | 49/237 |
| 1,214,748 | 2/1917 | Brand | 16/284 |
| 1,996,196 | 4/1935 | Ferris | 16/284 X |
| 2,604,654 | 7/1952 | Anderson et al. | 16/303 |
| 3,222,806 | 12/1965 | Martin | 16/313 X |
| 4,124,955 | 11/1978 | Kochis | 49/237 |

*Primary Examiner*—Fred Silverberg
*Attorney, Agent, or Firm*—Edward J. Utz

[57] ABSTRACT

A self-closing door hinge for a curtain door mounted within a frame consisting of a channel having a double helical track and a roller on said helical track which is returned to a pre-selected position after movement in either direction by compression of a spring thereby moving an arm carrying a curtain door connected to said channel to a preselected position.

3 Claims, 3 Drawing Figures

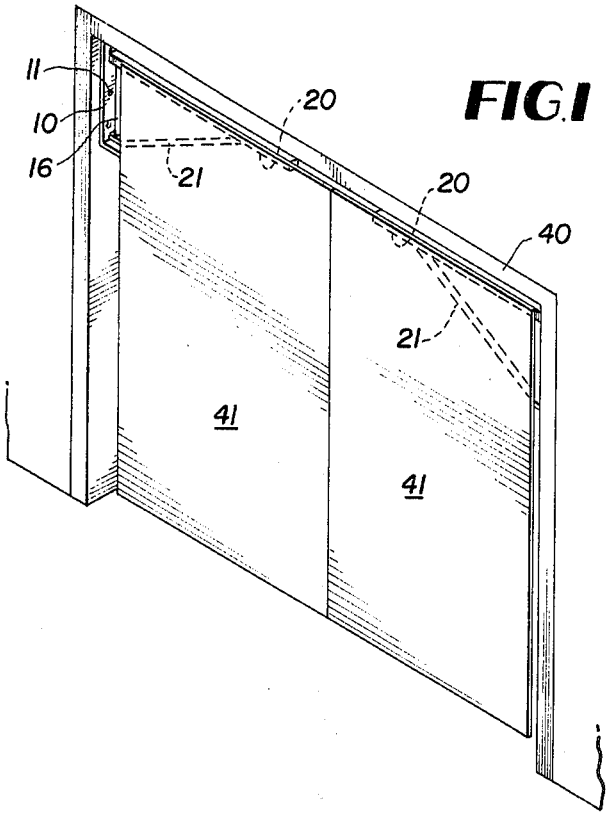
FIG. 1
FIG. 3
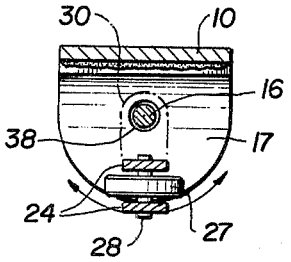
FIG. 2
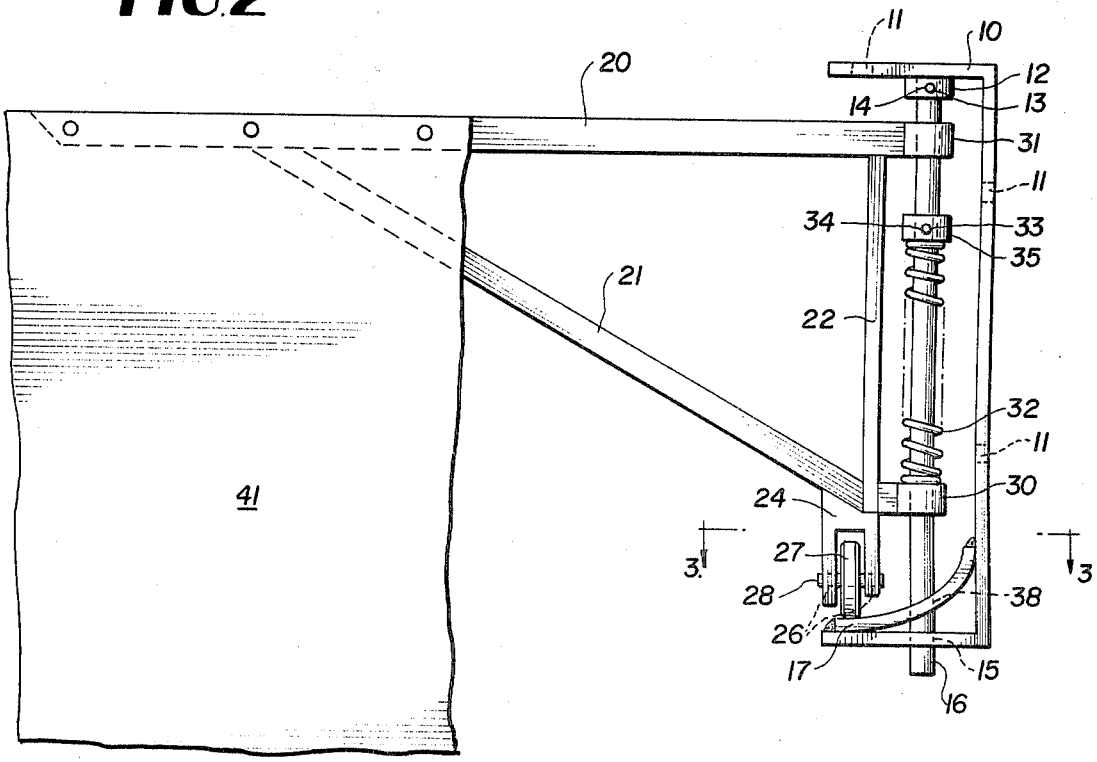

SELF-CLOSING DOOR HINGE

My invention relates to a self-closing door hinge which is hung from a single arm that swings approximately 180° and is attached to a door jamb mounted below the door leader.

Self closing doors are highly useful in commercial and industrial operations where there is extensive traffic between cold zones and warm zones. Energy saving mandates that the doors close promptly with a minimum of effort by the person utilizing said opening. Un-manned devices, such as conveyors, passing through an opening in a wall, require self closing doors if there is a large temperature difference between areas, or for noxious fume areas such as paint spray tunnels located in a personnel work area, and recent requirements developed by the Occupational Safety and Health Administration mandate that areas in which high noise levels occur must be enclosed by sound barrier screens or walls, and this creates still another application for self-closing doors.

Prior to my invention, self-closing doors have been activated by various arrangements of springs and the use of such devices as pressured air or vacuum driven pistons. Motor drives to close openings require some type of electric, electronic or sonic control that requires manipulation by the personnel passing through the opening, or electronic sensors, and the arrangement is thus prone to mechanical failure. Mechanical drives are effective only with rigid panel doors, which may be unit construction or rigid panels running in tracks or the like. The spring, gravity and air or vacuum position devices are reasonably trouble free for small doors of light weight construction, but since the force required to close the door must be generated by the opening action, large doors, over 48" in width and over 84" in height, weighing several hundred pounds create a mobility problem.

A useful and desirable feature of doors used in the above discussed applications is that they be transparent, or at least sufficiently translucent that a person or operator of a vehicle approaching the passage can see or become aware of any obstruction on the opposite side of the door, or of other personnel intending to pass through from the opposite direction. Materials such as sheet glass or clear plastic are obviously too frangible for severity of commercial and industrial traffic, so that sheet or strip flexible plastic of suitable thickness must be used.

The flexible plastic has the further advantage that it can be pushed open by vehicles, or personnel carrying boxes or the like requiring use of both hands, without strain on the door structure, as would occur with a rigid panel door. In addition, the elastic yielding of the draped plastic sheet makes it unnecessary to rotate the carrying arm or bar a full 90° open to allow passage, minimizing the pressure that must be applied to the door in use.

It is the principal object of my invention to provide a self-closing door hinge for use with curtain doors that is of simple, economical construction, easy to assemble and convenient to mount on doorway frames.

It is a further object of this invention to provide a hinge that uses a spring so positioned to compress when the door is opened, and release said automatically when the door is closed. A further objective of my invention is to provide a range of adjustment of the spring exerted in operation, to accommodate doors of various size and weight as well as speed of closure by use of a single size hinge.

A further object is to provide a simple, durable means for using the force of gravity simultaneously with the activation of the spring to increase the ease and speed of the self-closing function.

These and other advantages and objects of my invention will be apparent from the description to follow.

In my invention the mounting element of the hinge consists of a channel section of which the top flange is somewhat longer than the bottom flange so as to provide space on the outer edge for one or more holes through which fasteners such as lag bolts can pass to secure the flange to the header, or top framing member of the doorway. The depth, or web, of the channel depends on the weight of the flexible door material that the hinge is intended to carry, since it must be secured to the jamb, or vertical frame member of the doorway by fasteners in sufficient numbers to withstand the wracking and prying forces of the doors weight as it swings through an arc of 180° between full open positions on both sides of the doorway. The width of this channel segment also depends on the weight of the door, as does the thickness of the metal from which the channel is formed. The width of the channel is, however, limited by the width of the doorway jamb, since the channel section must be secured by a plurality of lag bolts or other suitable fasteners that pass through holes provided in the web of the channel.

The bottom flange of the channel is provided with a hole, located equidistant from the four edges of the flange, through which is passed a rod that extends vertically and parallel to the web of the channel. The centerline of the shaft and the vertical centerline of the channel web will lie in the same plane.

At the point at which the shaft, when extended, will contact the underside of the top flange of the channel, I provide a socket to receive the shaft. The socket is made from a short length of heavy walled tubing, the inside diameter of which will provide a snug fit to the shaft when inserted. This socket element is secured to the underside of the top flange of the channel by welding or by bolts applied from the top side of the flange through countersunk holes and engaging threaded holes provided in the walls of the socket. In the sidewall of the socket, I provide a small threaded hole to receive an allen set screw for securing the shaft when assembled.

The length of the shaft extends from its set in the socket on the upper flange down through the hole in the bottom flange. The diameter of the rod must provide sufficient cross-section to withstand the wracking and bending forces that will be exerted by the arm assembly carrying the flexible door material as it swings through 180° arcs. I have found that rods of 0.5" to 1.0" are adequate.

I provide a bracket arm consisting of a horizontal member of a length less than the width of the doorway, on which the flexible door material is hung.

At the end of the horizontal member I connect a bracket rod perpendicular to the arm. This member, which will be paralllel with and in the same vertical plane as the above described rod shaft.

To further strengthen and stiffen the swinging arm, I provide a third member of a suitable cross-section welded to the lower end of the vertical leg and extending diagonally upward to be welded to an appropriate point along the length of the horizontal arm, to form a rigid frame. The length and point of attachment of this knee brace member is governed by the calculations of the door material weight, the opening and closing stress thereon and the cross-section used in the horizontal arm.

I provide a pair of substantially identical collars, one of which is welded to the end of the horizontal member that carries the flexible door material at the mounting or pivoting end. The other collar is welded to the lower end of the vertical member. When the shaft is in place, its centerline is perpendicular to the horizontal arm, and parallel and in plane with the vertical leg member, which is also attached to the horizontal arm to accomplish a precision alignment.

To utilize the forces of gravity to rapidly close the door, I provide an arrangement of a roller and track. To the lower end of the vertical member of the frame that carries the flexible door material, I provide an inverted U-shaped stirrup, the bottom of which is welded to the bottom of the vertical leg so as to position the faces of the two parallel sides of the U at right angles to the axis of the horizontal arm both laterally and vertically.

At a point below the centerline of the U stirrup in inverted position, i.e., toward the downwardly disposed open end of the U, and on the centerline of the stirrup width, I provide a mating hole in each face to receive a pin axle, the location of the holes being such that said axle, when positioned, will be perpendicular to the centerline of the bracket shaft.

I provide a wheel attached to the frame, on the pin axle, and a track on which said wheel will travel when the door is turned 90° in either direction from its normally closed position. The contour of the track will have the shape of two oppositely circular spirals, the intersections of which are smoothly and curvedly joined. The spiral is a helix, i.e., a line so curved around a theoretical right cylinder that it would become a straight line if unfolded into a plane. The configuration of each of the two curves of the double helix track is identical to that of the flights of a common screw conveyor, and more particularly to that of a ribbon flight conveyor, the latter being a narrow strip mounted so as to provide space between the strip and its shaft. The pitch of the helix is the distance along the horizontal centerline of the cylinder between two points lying in a line laid on the outer radius parallel to the centerline of the cylinder. Since the door of the invention rotates only 90° in either direction, the rise in the height of the track at that point will be one quarter of the pitch of opposite helices.

The dimensions of the curved track piece thus formed will, in plane, be about the same as those of the bottom flange of the mounting channel. In height, or elevation, the helical track will extend to whatever level it is desired to cause the frame and flexible door material mounted thereon to rise, from which peak it descends when released as the wheel of the frame retraces its path down the helical track.

The above described curved helical track element is welded to the top of the lower flange of the mounting channel so that the low point where the two opposite curves intersect is at the center of the edge of said flange. The high point of intersection of the two curves is then welded to the web of the channel, at its vertical centerline.

To supplement the gravitational self-closing action of the door, I further provide a compression spring. The length of the spring is approximately the same as the distance between the two collars, and the strength of the spring is governed by the weight of the door and the desired speed at which the door is to close when operated.

The assembly of the self-closing hinge is described as follows. The frame is positioned within the channel bracket so that the holes of its two mounting collars are aligned with the socket on the top flange and the hole in the bottom flange, and with the wheel in contact with the low point of the double helical track on the bottom flange. The shaft is inserted from below through the hole in the bottom flange of the channel passing through the hole in the track, the lower mounting collar of the frame, the spring, the retaining collar of the spring, the upper mounting collar of the frame and into the socket on the underside of the top flange of the channel.

It can now be seen that as the frame is rotated 90° in either direction, the travelling of the wheel along the helically curved track will cause said frame to rise. If the spring is not engaged by its locking collar, it, too, will simply rise and provide no resistance or return pressure, i.e., the door will return to closed position by its own weight causing the wheel to roll back down the track. To accelerate the rate of closing, the spring is compressed and the retaining collar is simply locked against it in the desired position on the shaft. The rising of the frame now will further compress the spring against the collar, since the other end of the spring bears on the lower mounting collar of the frame.

From the description of the assembly and operation of the self-closing hinge, it will now be obvious that vertical depth of the channel must be slightly greater than the depth of the movable frame plus twice the distance the frame will rise during 90° rotation plus the distance from the bottom of the vertical frame member to the bottom of the wheel mounted thereon. It will further be evident that the space between the shaft and the parallel vertical frame member must be wide enough to allow positioning of the spring retaining collar and for the spring when it is expanded in compression.

Mounting this novel hinge and door consists simply of securing the channel at the intersection of the doorway header and jamb by bolts, lag screws, welding or bonding, and hanging the flexible curtain material from the horizontal area of the frame.

It will be obvious to those skilled in the art thay my invention can be modified to provide additional advantages without departing from the spirit of the invention as described above.

In the drawings the same reference numerals are used to indicate the same or similar parts, and the sectional view is taken along the line looking in the direction of the arrows at the end of the section line.

FIG. 1 is a view in perspective of the hinge and door in closed position.

FIG. 2 is a view in side elevation of the door hinge construction; and

FIG. 3 is a detailed, sectional view taken along the ends of the section line of FIG. 2.

A channel shaped member 10 is formed by brake-bending from steel strip. Six mounting holes 11 are provided in the channel web. A seventh mounting hole is provided from the outer edge of the upper flange, on the vertical centerline of the channel to receive a lag screw (not shown) to provide additional anchorage to the channel when it is attached to the header and jamb of the doorway.

To the underside of the upper flange 10 is welded a tubular socket 12. Midway in the length of this socket is provided a threaded hole 13, completely through the tubing wall, in which a locking set screw 14 is inserted.

In the bottom flange of the channel 10 is a drilled or punched hole 15, the center of which is exactly plumb with the center line of the hole in socket 12 welded to the underside of the top flange 10. The two cooperating holes retain the mounting rod 16 in the complete assembly, in exact parallel alignment with the vertical centerline of the channel, as will be described hereinafter.

To the outer edge, on the upper face, of the lower flange of channel 10, is welded a curved sheet 17 of thick steel plate, cut, in its initial flat state, in the shape of an oval. The curvature of the steel member 17 formed by then pressing in a die, consists of a right handed helix intersecting a left hand helix at the other edge of the channel flange in the plane of the centerline of the channel 10, each helix oppositely curving upward and toward the web of the channel 10 and having as its center an imaginary line drawn between the center of the hole in the socket 12 attached to the top flange and hole 15 in the bottom flange of the channel. The helices again intersect and terminate at the web of the channel, at its centerline, at which point the curved sheet 17 is welded to the web. The lower intersection of this double helix would normally be a V-shaped point. To provide a smooth transition from one helix to the other, this V-shaped point is further bent to form a circular arc tangential to the curves of the helices along the path of each helical curve. The outer edge of the formed plate 17 thereby provides a pair of opposite tracks rising from the outer edge of the lower flange to an intersection with the web at its vertical centerline above the top surface of the lower flange of channel 10, each point on the centerline of said tracks being the same radius distance from the centerline of the double helix, said centerline corresponding with that of the hole in the aligned upper socket 12 and the lower flange hole 15.

The frame 20 on which the flexible door material is to be carried, consists of a horizontal arm.

To the lower, downward end of vertical member 22 is welded a U-shaped stirrup 24, the open end thereof being downwardly disposed. This inverted stirrup 24 is weldedly attached by its bottom portion to the bottom of the frame member 22 in centered alignment with the center line of member 22 and having the planes of the stirrup face perpendicular to the centerline plane of frame 20.

Mating holes 26 are provided through each face of stirrup 24.

A ball bearing wheel 27 is positioned so that its axle hole is aligned with the two holes in the faces of stirrup 24. A bolt 28 is passed through the unthreaded hole and through the wheel axle hole to become threadly engaged with the hole in the other face of the stirrup 24.

Finally, the two identical collars 30 and 31 are welded respectively to the top and bottom ends of vertical frame member 22 and are positioned so that a common centerline between both holes is parallel to the vertical centerline of frame member 22 and lying in the centerline plane of frame 20 extended through member 22. The top of collar 31 is flush with the top side of frame horizontal member 20, and the bottom face of collar 30 is flush with the bottom end of vertical member 22.

To provide spring action that will supplement the gravity closing of the frame 20 when assembled with the channel 10, a compression spring 32 is supplied. This spring has flattened ends whereby to be solidly engaged at its restraining seats, the bottom one of which is collar 30 on the frame 20. The other, adjustable restraint is a collar 35, having in the sidewall thereof a threaded hole 33, to receive a set screw 34, which secures said collar 35 in the desired position along axle rod 16 after assembly and mounting of the door.

The several above described components may now be assembled into a complete, self-closing hinge for curtain doors. The frame 20 is placed perpendicular to the web of channel 10, the horizontal arm of frame 20 thereof extending away from the web of the channel 10 and the vertical plane of the frame 20 coinciding with the vertical centerline of the channel 10. This positions frame collars 30 and 31 with their centerlines coinciding with the centerlines of socket 12 on the top flange of the channel and hole 15 in the bottom flange. Rod 16 is inserted through holes 15 and 38 and passed upward through collar 30. Spring 32 is then positioned so that rod 16 can be further extended through its center bore. As rod 16 emerges from spring 32, it is next inserted in and passed through collar 31 and on through collar 15. The rod 16 is then inserted in socket 12 where it is secured by set screw 14.

When channel 10 is positioned upright the weight of frame 20 will now cause wheel 27 to rest on the helical track 16. Therefore as frame 20 is moved so as to revolve around rod 16, the travel of the wheel 27 along track 16 will cause frame 20 to rise. When the frame 20 is released from the thus elevated position, its weight will activate wheel 27 to roll down the track 17, causing frame 20 to rotate and descend back into the plane perpendicular to the web of channel 10, i.e., the door closed position.

To accelerate the self-closing action, spring 32 may now be compressed to the desired force level and secured by collar 35, in turn secured to shaft 16 by set screw 34. The rotation of frame 20, and the attendant rising of collar 35 therewith, now causes collar 35 to compress spring 32 against fixed retaining collar 35 thereby to store compressive force that is released to accelerate the rate of rotational return of frame 20 to closed position.

The operation of frame 20 is identical regardless of the direction of rotation, since the double helicoid track 17 is symetrical about its centerline plane perpendicular to the vertical centerline of channel 10.

The mounting of the assembled hinge on the doorway is accomplished by positioning the back face of channel 10 with its web vertically disposed in intimate contact and centered on the jamb 40 and the top flange of the channel 10 disposed from the door frame corner, in intimate contact with the doorway header.

The mounted hinge is then ready to receive the flexible sheet of material 41 that comprises the actual door face.

Having thus described my invention, I claim as follows:

1. A self-closing door hinge in combination with a curtain door mounted within a door jam comprising, a channel section affixed to said door jam, a mounting rod mounted within said channel section, an arm rotatable on said mounting rod to which the curtain door is secured, a spring surrounding a selected portion of said mounting rod a roller secured to said arm, an oval curved sheet member affixed to said channel which forms a right-hand helix intersecting a lefthand helix on which said roller rides, and a collar adjustably mounted on said mounting rod to secure said spring in a selected compressed position to provide spring action to supplement the gravity closing of the door.

2. The self-closing door hinge described in claim 1 wherein each said helix oppositely curving upward and shaped at its intersection to form a circular arc tangential to the curves of the helices along the path of each said helix curve to provide a pair of opposite tracks.

3. The self-closing door hinge described in claim 1 wherein the oval curved sheet member which forms a double helicoid track is symmetrical.

* * * * *